US006283471B1

(12) United States Patent
Künzel et al.

(10) Patent No.: US 6,283,471 B1
(45) Date of Patent: Sep. 4, 2001

(54) METHOD AND DEVICE FOR CONTROLLING SHEET FEED TO A SHEET-PROCESSING MACHINE

(75) Inventors: Markus Künzel, Darmstadt; Tobias Müller, Hirschberg; Thomas Wolf, Karlsruhe, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/441,896

(22) Filed: Nov. 17, 1999

(30) Foreign Application Priority Data

Nov. 17, 1998 (DE) ..... 198 52 974

(51) Int. Cl.[7] ..... B65H 7/08; B65H 7/10; B65H 9/00; B65H 7/02

(52) U.S. Cl. ..... 271/227; 399/731; 400/579; 271/227; 271/265.03

(58) Field of Search ..... 271/227, 265, 271/225–255; 399/371; 198/464.4; 400/579; 414/19; 250/559.3, 559.4

(56) References Cited

U.S. PATENT DOCUMENTS 4,438,918 * 3/1984 Ito et al. ..... 271/251
4,819,783 * 4/1989 Pinyan et al. ..... 198/395 X
5,004,928 * 4/1991 Suzuki et al. ..... 250/559
5,848,344 * 12/1998 Milillo et al. ..... 399/395 X

* cited by examiner

*Primary Examiner*—H. Grant Skaggs
*Assistant Examiner*—Kenneth W Bower
(74) *Attorney, Agent, or Firm*—Herbert L. Lerner; Laurence A. Greenberg; Werner H. Stemer

(57) ABSTRACT

A method of controlling sheet feed to a sheet-processing machine, wherein sheets are separated from a pile, conveyed onto a table, brought individually into contact with alignment lays for leading edges of the sheets, and conveyed onward therefrom individually for processing in the machine, includes, upon misalignment of a sheet, generating a signal by ultrasonic detectors active in transmission operation, the ultrasonic detectors being fixedly disposed parallel to the alignment lays and including two ultrasonic transmitters arranged at a defined distance, and ultrasonic receivers associated therewith, maintaining over the area of a measuring window sonic energy flux originating from the ultrasonic transmitters, respectively, at a substantially constant sonic intensity in the conveying direction of the sheets, integrally detecting by the respective ultrasonic receiver the sonic energy passing through the measuring window, and simultaneously measuring a difference in the sonic energy measured by the ultrasonic receivers; and a device for performing the method.

12 Claims, 3 Drawing Sheets

Fig. 3.1
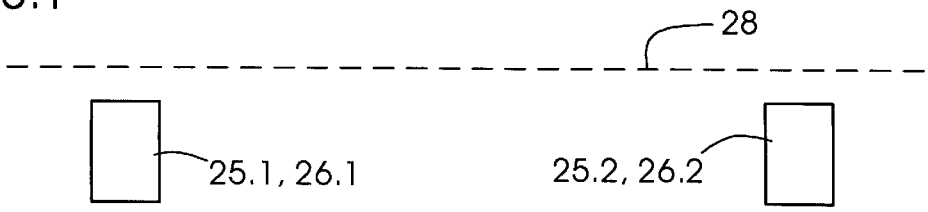
Fig. 3.2
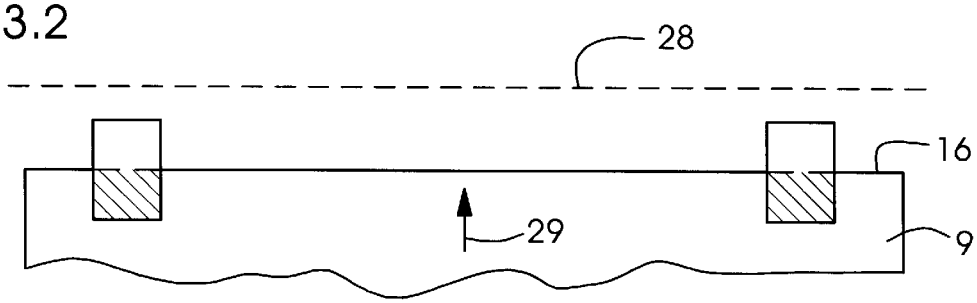
Fig. 3.3
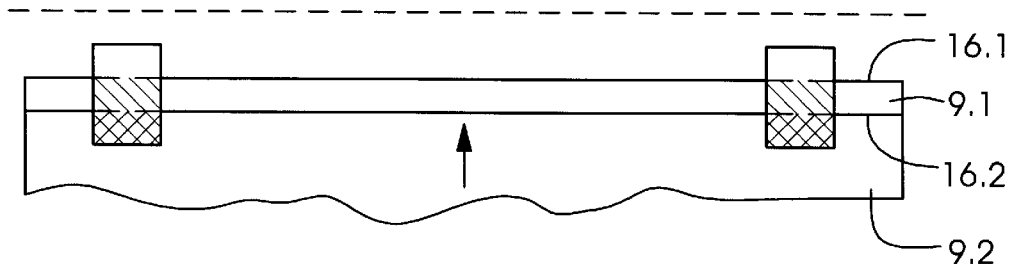
Fig. 3.4
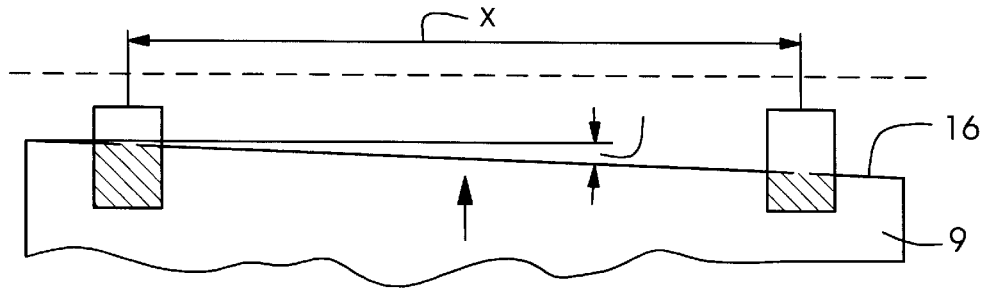
Fig. 3.5
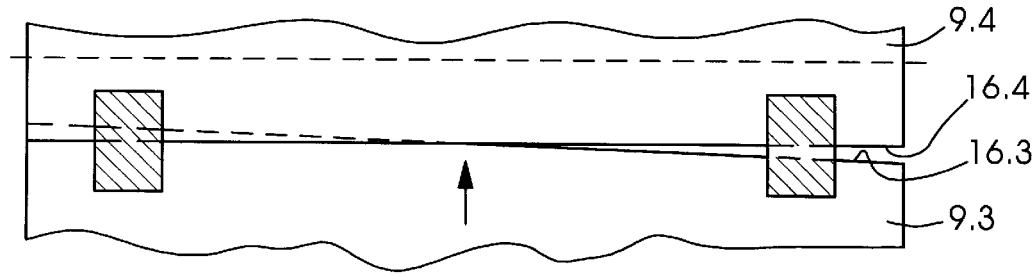

METHOD AND DEVICE FOR CONTROLLING SHEET FEED TO A SHEET-PROCESSING MACHINE

BACKGROUND OF THE INVENTION

FIELD OF THE INVENTION

The invention relates to a method and device for controlling sheet feed to a sheet-processing machine, especially to a printing machine.

In order to avoid damage to a printing machine, it has become known heretofore to provide sensors or detectors which respond to an incorrect feed. An incorrect feed exists when more than the contemplated number of sheets is being fed, when the position, the thickness or the material of the sheets is not as desired, or when the sheets are damaged, have holes formed therein or are dog-eared, i.e., have folded-over corners. In machines which process a great number of sheets per unit time, the sheets, which have been singly separated from a sheet pile, are conveyed onto a feed table in imbricated or overlapped form and, for processing, are individually brought to alignment stops. In this type of sheet feed, the requirements imposed upon the detectors are particularly high. Improvements have become known wherein, in order to increase security and reliability, several detectors are provided in the conveying path of the sheets. In order to be sensitive to various sheet materials, detectors may be provided which operate in accordance with different physical principles. For example, a photoelectric sensor can be provided for detecting thin paper sheets in transmitted-light operation and, additionally, a capacitive or inductive sensor may be provided for detecting metal-coated sheets.

In printing machines, the position of sheets on the front lays is decisive for the print quality that can be achieved. In the East German Patent Document DD 200563 A1, an individual sensor responsive to the presence of a sheet is provided for the purpose of detecting and evaluating a faulty feed of folded sheets in the conveying path. In addition, rows of a large number of individual sensors are provided which are arranged parallel and perpendicular to the conveying direction. With the aid of a microcomputer, the number of sensors which are covered by the sheet in the conveying direction and transversely thereto can be determined. The sheet format and a misaligned attitude of a sheet can be calculated from the number of the sensors and from the known distances between the sensors. If the dimensions and the angular attitude of a sheet exceed predefined limiting values, an error signal is generated. The resolution of the positional measurement in the conveying direction is limited by the smallest distance between the rows of sensors. The error signal can be used to activate a device for correcting the attitude and/or to stop the processing machine or the sheet singling or separating and the sheet feed.

For the aforementioned reasons, it has become known heretofore to provide ultrasonic detectors in the conveying path in order to monitor misfed and/or multiple sheets (note the published East German Patent Document DD 238 955 A1). Using a reference sheet, the ultrasonic detector arrangement, which includes a transmitter and a receiver, is calibrated. The receiver contains a comparator circuit having an adjustable threshold. During the feeding of sheets, the comparator flips into a second state thereof when an excessively thick sheet, or two or more sheets simultaneously run past the sensing location of the detector circuit. Due to the high gain of the comparator, the ultrasonic detector arrangement exhibits a quasi-digital behavior. With the aid of a differential amplifier, it is possible to reduce errors resulting from interfering variables and drift in the transmitter frequency and phase.

A device for determining double sheets disclosed in the German Patent 12 00 842 is based upon the detection of the amount of energy loss of longitudinal air-pressure oscillations as they pass through one or more sheets. In order to detect a double sheet, use is made of the fact that the energy loss is considerably greater when two sheets lie above one another than when the oscillations pass through only one sheet. This energy loss essentially arises at the interfaces between two sheets. The thickness of the sheet material and the coating thereof with printing ink or powder has only an insignificant influence. If the energy at the receiver for longitudinal air-pressure oscillations falls below an adjustable value, a switching operation is triggered via an amplifier. The device is constructed only for monitoring double sheets. A simultaneous detection of the attitude of the sheets in a sheet transport device is not contemplated here.

If two or more ultrasonic edge detectors are provided and are disposed transversely to the conveying direction, it is possible to detect a misaligned attitude of a sheet by is determining the time difference occurring at a leading edge of the sheet. Such an improvement is described in the published Japanese Patent Document JP 61-206758 (A).

In such attitude measurements which are based upon a time measurement, the accuracy of the attitude measurement depends to a considerable extent upon the stability of the trigger threshold of comparators. The time measurements are complicated and costly.

SUMMARY OF THE INVENTION

It is accordingly an object of the invention to provide a method and a device for controlling sheet feed to a sheet-processing machine which, by using a simple ultrasonic device, increases sheet-detection accuracy.

With the foregoing and other objects in view, there is provided, in accordance with one aspect of the invention, a method of controlling sheet feed to a sheet-processing machine, wherein sheets are separated from a pile, conveyed onto a table, brought individually into contact with alignment lays for leading edges of the sheets, and conveyed onward therefrom individually for processing in the machine, which comprises, upon misalignment of a sheet, generating a signal by ultrasonic detectors active in transmission operation, the ultrasonic detectors being fixedly disposed parallel to the alignment lays and including two ultrasonic transmitters arranged at a defined distance, and ultrasonic receivers associated therewith, maintaining over the area of a measuring window sonic energy flux originating from the ultrasonic transmitters, respectively, at a substantially constant sonic intensity in the conveying direction of the sheets, integrally detecting by the respective ultrasonic receiver the sonic energy passing through the measuring window, and simultaneously measuring a difference in the sonic energy measured by the ultrasonic receivers.

In accordance with another mode, the method of the invention includes measuring the sonic energy several times per sheet.

In accordance with a further mode, the method of the invention includes varying the number of measurements per sheet in accordance with the number of sheets fed per unit time.

In accordance with an added mode, the method of the invention includes varying, in accordance with the number of sheets fed per unit time, the instant of time at which the sonic energy is measured.

In accordance with an additional mode, the method of the invention includes having, for each measurement, at least one sonic pulse emitted by the respective sonic transmitter.

In accordance with another aspect of the invention, there is provided a device for detecting sheets at alignment lays as the sheets are fed to a sheet-processing machine, ultrasonic transmitters and ultrasonic receivers being provided pairwise upline of a line formed by the alignment lays, as viewed in a conveying direction of the sheets, comprising a measuring window assigned to an ultrasonic sensor that includes respective pairs of the ultrasonic transmitters and the ultrasonic receivers, the respective ultrasonic transmitters being capable of radiating sonic energy flux perpendicularly to the conveying direction of the sheet, the sonic energy flux having a constant sonic intensity over the area of the measuring window assigned to the ultrasonic sensor, sonic energy from the sonic energy flux passing through a sheet entering the measuring window, the ultrasonic receivers being capable of detecting integrally the sonic energy passing through the measuring window, and further comprising a difference forming device connected to the ultrasonic receivers.

In accordance with another feature of the invention, the detecting device includes a further ultrasonic detector active in transmission operation disposed downline of the line formed by the alignment lays, as viewed in the conveying direction of the sheets.

In accordance with a further feature of the invention, the measuring window extends over a greater distance in the conveying direction of the sheets than in directions transverse to the conveying direction.

In accordance with an added feature of the invention, the measuring window is rectangular.

In accordance with an alternative feature of the invention, the measuring window is elliptical.

In accordance with an additional feature of the invention, the measuring window and the ultrasonic detectors, respectively, are positionable in the sheet conveying direction.

In accordance with a concomitant feature of the invention, the detecting device comprises, for sheets fed in an imbricated manner, a further sheet detector disposed upline of the pairs of ultrasonic detectors, as viewed in the conveying direction of the sheets.

The method permits, in the region of the alignment lays, the simultaneous detection of a series of undesired events in the course of the sheet run or travel, such as a missing sheet, a sheet delivered too early or too late, an impermissible number of sheets or an obliquely disposed sheet. This is performed without contact, and can be carried out in the conveying direction of the sheets over a wide detection region. The type of printing material and the thickness of the printing material are not critical. As a result, for example, in the case of a printing machine, it becomes possible, before the actual printing operation, to feed sheets which are formed of a different material from the sheets used in continuous printing. Thus, during the set-up phase of a printing machine, low-quality sheets or set-up sheets made of a special material can be fed. Malfunctioning of the ultrasonic detectors does not occur because of the different material. Separate calibration of the ultrasonic detectors to a specific sheet material or a specific sheet thickness is not necessary. Predefining the type and thickness of the sheets is not necessary, which avoids errors resulting from manual inputs.

A system having two ultrasonic detectors, which are provided in the sheet run and are parallel and upline of the stop lays which are arranged in a line, permits detection even if a sheet has folded-over corners, i.e., are dog-eared, and the sheets lie irregularly in the event of overlapping or imbricated feed. The invention is based upon the measurement of the proportion of coverage by sheets of an ultrasonic measuring window. Ultrasonic detectors having circular or rectangular measuring windows are particularly advantageous.

Other features which are considered as characteristic for the invention are set forth in the appended claims.

Although the invention is illustrated and described herein as embodied in a method and device for controlling sheet feed to a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG., 1 is a schematic and diagrammatic side elevational view of a sheet feeder;

FIGS. 3.1 to 3.5 are reduced fragmentary views of FIG. 2 showing exemplary embodiments with different situations relating to the detection of sheets.

DESCRIPTION OF THE PREFERRED EMBODIMENTS

Figure 1:
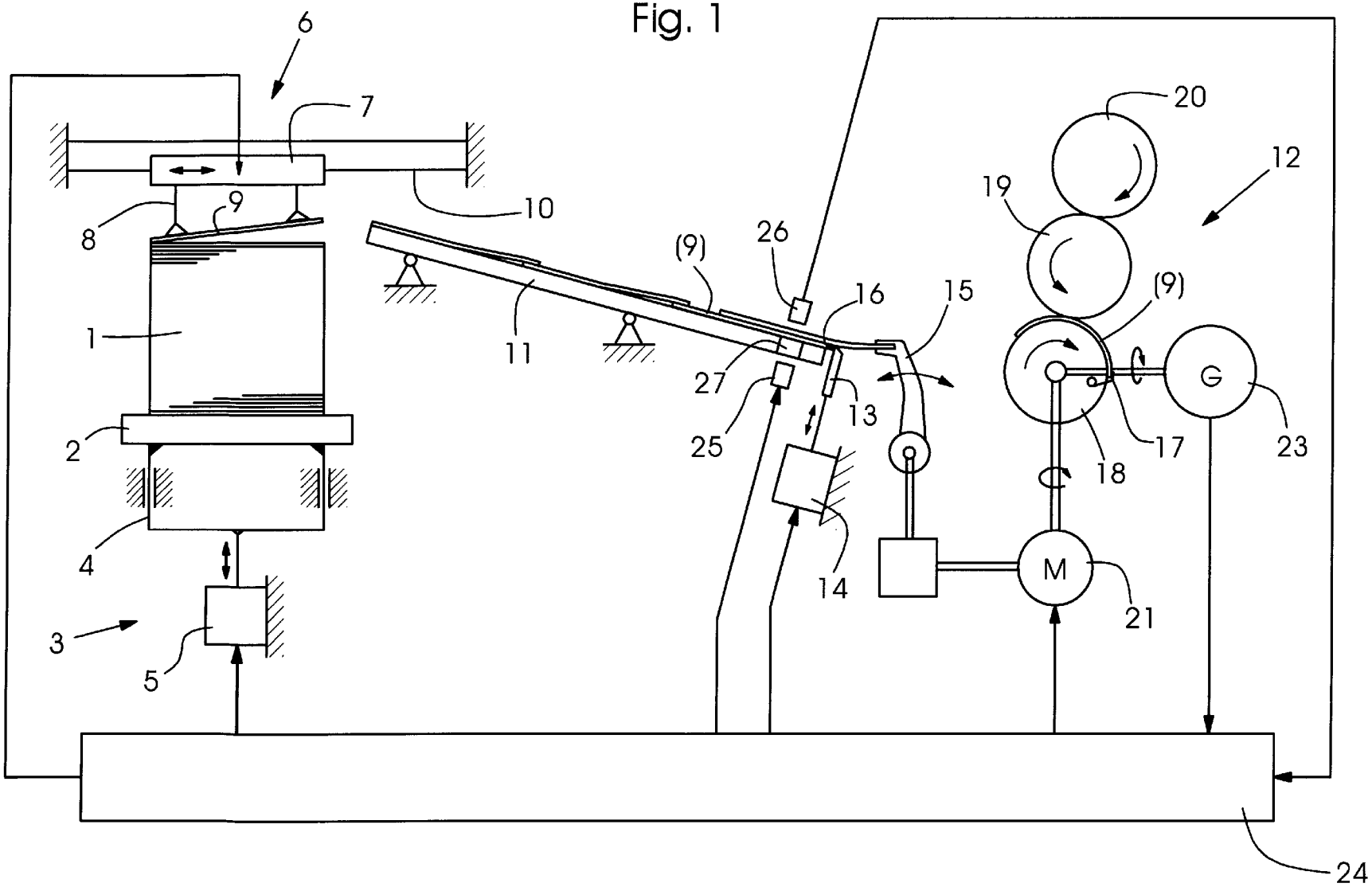

Referring now to the drawings and, first, particularly, to FIG. 1 thereof, there is shown therein a schematic and diagrammatic view of a sheet feeder or sheet feeding device of a sheet-fed printing machine, with which the method of the invention can be performed. A sheet pile 1 lies on a pile table 2 coupled to a lifting device 3 that includes a vertical guide 4 and an operating cylinder 5. Arranged above the sheet pile 1 is a singling or separating device 6 having a suction head 7 with suckers 8. The suction head 7 is reciprocatingly movable horizontally with the aid of a longitudinal guide 10 in order to transport separated sheets 9. A feed table 11 serves to make the sheets 9 ready for further processing in the succeeding printing unit 12 of the sheet printing machine. The sheets 9 are conveyed onto the feed table 11 in overlapping or imbricated form. The respective next sheet 9 that is provided for printing lies in alignment against alignment lays 13. With the aid of an operating cylinder 14, the alignment lays 13 are withdrawable cyclically below the level of the supporting surface of the feed table 11. An oscillating gripper 15, respectively, grips the sheet 9, that is provided at the alignment lays 13, by the leading edge 16 of the sheet 9 and transfers the sheet 9 to a gripper system 17 of a printing cylinder 18 of the printing unit 12. The printing cylinder 18, a transfer cylinder 19 and a printing-form cylinder 20 are coupled with a gear train and are driven synchronously by a motor 21. The drive of the suction head 7, the operating cylinders 5 and 14, the motor 21 and a rotary encoder 23 are connected to a control and regulating device 24. In order to control the feed of the sheets 9, several ultrasonic transmitters 25 and ultrasonic receivers 26 are provided parallel to the alignment lays 13. Openings 27 formed in the feed table 11 permit sound to pass therethrough. The ultrasonic transmitter 25 and the ultrasonic receiver 26 are likewise connected to the control and regulating device 24.

Figure 2:
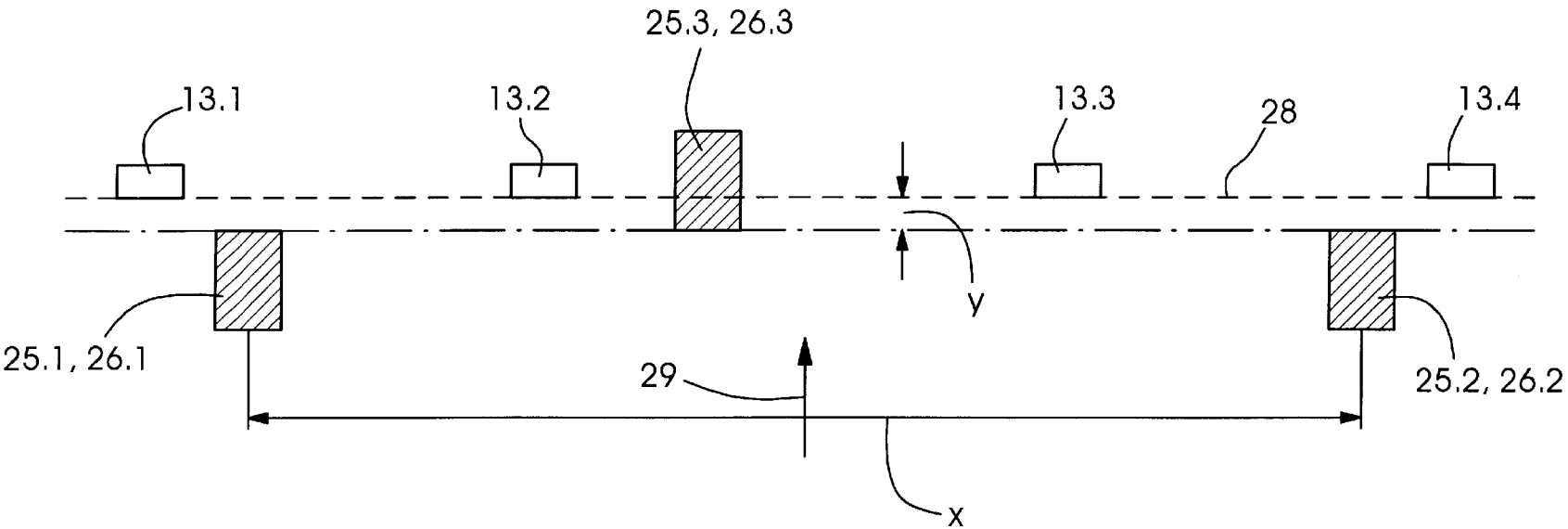
FIG. 2 is an enlarged fragmentary top plan view of FIG. 1, showing an arrangement of ultrasonic detectors.

FIG. 2 is a plan view of the feed table 11 in the region of the alignment lays 13.1 to 13.4. The alignment lays 13.1 to 13.4 are arranged along a line 28 lying substantially perpendicularly to a sheet-conveying direction represented by the arrow 29. The positions of the alignment lays 13.1 to 13.4 in the conveying direction 29 can be matched with the aid of a device to the shape of the leading edges 16 of the respective sheets 9. Arranged at a defined distance y, parallel to the line 28, are two pairs of ultrasonic transmitters 25.1, 25.2 and ultrasonic receivers 26.1, 26.2, which are disposed a defined distance x from one another, so that the ultrasonic detection takes place as much as possible in the vicinity or region of the side edges of a sheet 9. In order to adjust to various formats of the sheet 9, these pairs of transmitters 25.1, 2S.2, 26.1, 26.2 are adjustable perpendicularly to the conveying direction 29. As viewed in the conveying direction 29, a further ultrasonic detector 25.3, 26.3 is arranged between the ultrasonic transmitters 25.1, 25.2 and the ultrasonic receivers 26.1, 26.2, respectively. The detection range of this ultrasonic detector 25.3, 26.3 extends beyond the line 28 in the conveying direction 29. In FIG. 2, the ultrasonic transmitters 25.1, 25.2, 25.3 and the ultrasonic receivers 26.1, 26.2, 26.3 are shown having a rectangular cross section, the ultrasonic transmitters 25.1, 25.2, 25.3 emitting sonic energy homogeneously over the cross-sectional area. The cross-sectional areas form measuring windows, the longer sides being disposed in the conveying direction 29. The cross-sectional areas of the measuring windows can likewise be circular or elliptical.

The mode of operation of the aforedescribed arrangement is explained hereinafter with reference to FIG. 3. The feed of the sheets 9 must take place synchronously and cyclically at the cycling rate of the sheet printing machine. In the case of single-turn machines, a cycle is defined by a 360°-rotation of the printing cylinder 18. FIGS. 3.1 to 3.5 show the position of one or more sheets 9 at a predefined rotary-angle position of the printing cylinder 8. The predefined rotary-angle position is stored in the control and regulating device 24. When the actual angle of rotation output by the rotary encoder 23 has reached the stored nominal or desired angle of rotation, a signal is emitted, due to which the sonic energy levels present on the ultrasonic receiver 26.1, 26.2, 26.3 are read into the control and regulating device 24.

In the state shown in FIG. 3.1, there is no sheet 9 in the measuring window of the ultrasonic detectors 25.1, 25.3, 26.1, 26.3. The complete undamped or unattenuated sonic energy level falls onto the ultrasonic receivers 26.1 to 26.3, i.e., the transmission value T between the ultrasonic transmitters 25.1 to 25.3 and the ultrasonic receivers 26.1, 26.3 is, in standardized form, Ti=T2=T3=1. In this case, a signal is generated in the control and regulating device 24 to the effect that a so-called missing sheet or a so-called late sheet is present. To test whether this is a late sheet, it is possible to use signals from further sheet detectors, which are arranged upstream of the ultrasonic detectors 25.1–25.3, 26.1,2.6.3, as viewed in the sheet travel direction.

FIG. 3.2 shows the state of the disruption-free feed. The leading edge 16 of the sheet 9 is located in a desired position at the predefined angle of rotation. In the desired position of the sheet 9, respectively, half of the measuring windows are covered. The transmission values T1, T2 on the ultrasonic detectors 25.1, 26.1 and 25.2, 26.3 are equal in value but are reduced to $1/100^{th}$ the value thereof, i.e., T1 T2=0.01. In this case, the control and regulating device 24 generates a release signal that effects the onward transport of the sheet 9 into the printing unit 12.

FIG., 3.3 depicts the simultaneous feeding of two sheets 9.1 and 9.2. If we assume that each sheet 9.1, 9.2 reduces the transmission values by the factor 1/100 in the same way, then the transmission values Ti=T2=0.01×0.01=0.0001 are the result on the ultrasonic detectors 25.1, 26.1 and 25.2, 26.2, respectively. With the aid of the control and regulating device 24, a signal is derived therefrom to the effect that a so-called double sheet has been fed. The feed of the sheets 9, 9.1, 9.2 can then be stopped.

FIG. 3.4 illustrates the case wherein a single sheet 9 has been fed forward slightly rotated with respect to the conveying direction 29, i.e., the measuring window of the one ultrasonic detector 25.1, 26.1 is covered to a somewhat greater extent than the measuring window of the other ultrasonic detector 25.2, 26.2. Accordingly, the transmission values T1, T2 or the detected sonic energy levels also differ. If a transmission value T1=0.2 is present on the ultrasonic detector 25.1, 26.1, and a transmission value T2=0.8 is present on the ultrasonic detector 26.1, 26.2, then the control and regulating device 24 can be used to derive a signal from the difference T2−T1=0.6 to the effect that this is a so-called misaligned sheet. The angle of rotation $\alpha$ can be calculated from the difference T2−T1 and the distance x between the ultrasonic detectors 25.1, 26.1 and 25.2, 26.2, respectively.

FIG. 3.5 illustrates the case wherein, as in FIG. 3.4, a misaligned sheet 9.3 has been fed, while at the same time a preceding sheet 9.4 is being transported to the printing unit 12 with the aid of the oscillating gripper 15. By comparison with FIG. 3, the transmission values T1, T2, respectively, are reduced by the factor 1/00 by the sheet 9.4 lying above the sheet 9.3, i.e., Ti=0.2×0.01=0.002 and T2=0.8×0.01=0.008. Here too, a difference T2−T1 can be evaluated, so that a signal for the misaligned sheet 9.3 can be derived and the misaligned attitude in angular terms can be outputted. The value for the angular rotation of the misaligned sheets 9.3 can be used to drive actuating elements, such as movable side-edge pull lays, which effect the correct alignment of the leading edge 16.3 on the alignment lays 13.1–13.4. The difference T2−T1 can be obtained with the aid of a bridge connection of the ultrasonic receivers 26.1 and 26.2.

In an alternate mode of the method, the sonic energy levels of the ultrasonic receivers 26.1, 26.2 can be read out many times during each revolution of the impression cylinder 18. In the case of equally spaced reading operations, for example, at every 10 degrees of angle of rotation of the impression cylinder 18, the state of the sheet feed could be determined thirty-six times in one feed cycle. For each triggering operation, decisions will then have to be made, in the control and regulating device 24, as to how the signals from the ultrasonic receivers 26.1 and 26.2 are to be evaluated and which signals have to be outputted. The number and the time of the reading operations can be varied as a function of the printing speed of the sheet-fed printing machine. For example, it would be possible to read out more frequently at a lower printing speed and to advance the read-out times at a higher printing speed, in order to compensate for dead times of the measuring circuit elements. The control and regulating device 24 is able to process signals from further sheet detectors. For example, if the signal from the ultrasonic receiver 26.3 is included, it is possible to establish whether a sheet 9 has been fed impermissibly beyond the line 28. In this case, this would be a so-called early sheet, at which point a signal to stop the feed of the sheets 9 and to shut the printing unit 12 off is emitted or outputted.

Furthermore, additional sheet detectors, such as contact-free acting, capacitive displacement or motion pickup transmitters or sensing rollers lying on the stream of sheets, can be provided in the sheet run or travel upline of the ultrasonic detectors 25.1, 26.1 and 25.2, 26.2 respectively, the additional sheet detectors being suitable for detecting the simultaneous feed of more than one sheet 9. Cost-effective sheet detectors with a low resolution are suitable for this so-called package detection.

We Claim:

1. A method of controlling sheet feed to a sheet-processing machine, wherein sheets are separated from a pile, conveyed onto a table, brought individually into contact with alignment lays for leading edges of the sheets, and conveyed onward therefrom individually for processing in the machine, which comprises, upon misalignment of a sheet, generating a signal by ultrasonic detectors active in transmission operation, the ultrasonic detectors being fixedly disposed parallel to and upline from the alignment lays and including two ultrasonic transmitters arranged at a defined distance, and ultrasonic receivers associated therewith, maintaining over the area of a measuring window sonic energy flux originating from the ultrasonic transmitters, respectively, at a substantially constant sonic intensity in the conveying direction of the sheets, integrally detecting by the respective ultrasonic receiver the sonic energy passing through the measuring window, and simultaneously measuring a difference in the sonic energy measured by the ultrasonic receivers.

2. The method according to claim 1, which includes measuring the sonic energy several times per sheet.

3. The method according to claim 1, which includes varying the number of measurements per sheet in accordance with the number of sheets fed per unit time.

4. The method according to claim 1, which includes varying, in accordance with the number of sheets fed per unit time, the instant of time at which the sonic energy is measured.

5. The method according to claim 1, which includes having, for each measurement, at least one sonic pulse emitted by the respective sonic transmitter.

6. A device for detecting sheets at alignment lays as the sheets are fed to a sheet-processing machine, ultrasonic transmitters and ultrasonic receivers being provided pairwise upline of a line formed by the alignment lays, as viewed in a conveying direction of the sheets, comprising a measuring window assigned to an ultrasonic sensor that includes respective pairs of the ultrasonic transmitters and the ultrasonic receivers, the respective ultrasonic transmitters being capable of radiating sonic energy flux perpendicularly to the conveying direction of the sheet, the sonic energy flux having a constant sonic intensity over the area of the measuring window assigned to the ultrasonic sensor, sonic energy from the sonic energy flux passing through a sheet entering the measuring window, the ultrasonic receivers detecting integrally the sonic energy passing through the measuring window, and further comprising a difference forming device connected to the ultrasonic receivers.

7. The detecting device according to claim 6, including a further ultrasonic detector active in transmission operation disposed downline of said line formed by the alignment lays, as viewed in the conveying direction of the sheets.

8. The detecting device according to claim 6, wherein said measuring window extends over a greater distance in the conveying direction of the sheets than in directions transverse to the conveying direction.

9. The detecting device according to claim 6, comprising, for sheets fed in an imbricated manner, a further sheet detector disposed upline of the pairs of ultrasonic detectors, as viewed in the conveying direction of the sheets.

10. The detecting device according to claim 8, wherein said measuring window is rectangular.

11. The detecting device according to claim 8, wherein said measuring window is elliptical.

12. The detecting device according to claim 8, wherein said measuring window and said ultrasonic detector, respectively, are positionable in the sheet conveying direction.

* * * * *